US009238548B2

(12) United States Patent
Hooley et al.

(10) Patent No.: US 9,238,548 B2
(45) Date of Patent: Jan. 19, 2016

(54) RECEPTACLE WITH SPRING HINGE AND FORWARD LEAN

(71) Applicant: RUBBERMAID INCORPORATED, Huntersville, NC (US)

(72) Inventors: Bradley Hooley, Charlotte, NC (US); Scott Miller, Mooresville, NC (US); William Croft, Mooresville, NC (US)

(73) Assignee: RUBBERMAID INCORPORATED, Huntersville, NC (US)

( * ) Notice: Subject to any disclaimer, the term of this patent is extended or adjusted under 35 U.S.C. 154(b) by 0 days.

(21) Appl. No.: 14/036,400

(22) Filed: Sep. 25, 2013

(65) Prior Publication Data

US 2015/0083728 A1 Mar. 26, 2015

(51) Int. Cl.

| | |
|---|---|
| ***B65F 1/06*** | (2006.01) |
| ***B65F 1/14*** | (2006.01) |
| *B65F 1/02* | (2006.01) |

(52) U.S. Cl.

CPC ..... *B65F 1/06* (2013.01); *B65F 1/1615* (2013.01); *B65F 1/1623* (2013.01); *B65F 1/1646* (2013.01); *B65F 1/02* (2013.01)

(58) Field of Classification Search

CPC ..... B65F 1/06; B65F 1/1615; B65F 1/1623; B65F 1/1646; B65D 25/16; A45C 13/005; A45C 13/007; E05D 5/04; F16B 12/20

USPC ..... 220/495.08, 908, 908.3, 495.11; 248/101, 95, 99

See application file for complete search history.

(56) References Cited

U.S. PATENT DOCUMENTS

| | | | | |
|---|---|---|---|---|
| 1,840,616 | A | | 1/1932 | Burke |
| 2,145,613 | A | | 1/1939 | Shenk et al. |
| 2,202,238 | A | | 5/1940 | Thompson |
| 2,939,169 | A | * | 6/1960 | Anderson ..... 16/384 |
| 3,008,604 | A | | 11/1961 | Garner |
| 3,443,745 | A | | 5/1969 | Kleeberg |
| 3,799,391 | A | | 3/1974 | Brescia |
| 4,161,252 | A | * | 7/1979 | Howells ..... 211/126.2 |
| 4,630,752 | A | | 12/1986 | DeMars |
| 4,695,020 | A | * | 9/1987 | Collins ..... 248/100 |
| 4,753,367 | A | | 6/1988 | Miller et al. |
| 4,765,579 | A | | 8/1988 | Robbins, III et al. |
| 4,776,478 | A | | 10/1988 | Miller et al. |

(Continued)

OTHER PUBLICATIONS

McNamara, David, International Application No. PCT/US2008/084874, International Search Report, Jan. 28, 2009.

(Continued)

*Primary Examiner* — Andrew Perreault

(74) *Attorney, Agent, or Firm* — Marshall, Gerstein & Borun LLP

(57) ABSTRACT

A receptacle includes a container having a bottom wall and a side wall extending from the bottom wall. The side wall defines an opening and is comprised of a front wall portion and a back wall portion. A lid is secured to the container along the back wall portion at a spring hinge where the lid covers the opening. The front wall portion diverges as it extends away from the base at a first angle and the back wall portion diverges as it extends away from the base at a second angle where the first angle is greater than the second angle. The spring hinge defines an axis of rotation of the lid where the axis of rotation of the lid is outside of the rim of the opening. The lid is shaped and dimensioned such that the lid contacts the rim for substantially the entire periphery thereof.

20 Claims, 8 Drawing Sheets

(56) References Cited

U.S. PATENT DOCUMENTS

| | | | | |
|---|---|---|---|---|
| 4,917,263 | A | 4/1990 | Korb | |
| 4,935,740 | A | 6/1990 | Schouwenhaars et al. | |
| 5,242,074 | A | 9/1993 | Conaway et al. | |
| 5,310,078 | A | 5/1994 | Strawder | |
| 5,628,424 | A | 5/1997 | Gola | |
| 5,735,495 | A | 4/1998 | Kubota | |
| 5,803,300 | A | 9/1998 | DeMars | |
| 6,959,833 | B1 | 11/2005 | Paul | |
| 2004/0074907 | A1* | 4/2004 | Gardner | 220/495.11 |
| 2004/0238553 | A1 | 12/2004 | Lane et al. | |
| 2005/0205579 | A1 | 9/2005 | Buchalter et al. | |
| 2009/0261105 | A1 | 10/2009 | Cunningham et al. | |
| 2012/0118784 | A1* | 5/2012 | Decker et al. | 206/503 |
| 2012/0181282 | A1* | 7/2012 | Heller et al. | 220/495.08 |
| 2013/0161335 | A1* | 6/2013 | Rae | 220/573.1 |

OTHER PUBLICATIONS

McNamara, David, International Application No. PCT/US2008/084881, International Search Report, Jan. 29, 2009.

McNamara, David, International Application No. PCT/US2008/084874, International Preliminary Report on Patentability, Jun. 1, 2010.

Rubbermaid Incorporated, International Application No. PCT/US2008/084881, International Preliminary Report on Patentability, Jun. 1, 2010.

Sterilite, touch-top wastebaskets, http://www.sterilite.com/Category.html?Section=Household&ProductCategory=55.

HMS Mfg. Co., 14 Quart Hide-A-Bag Wastebasket, 2004, http://www.hmsmfg.com/products/housewares/2158.htm.

* cited by examiner

RECEPTACLE WITH SPRING HINGE AND FORWARD LEAN

BACKGROUND OF THE INVENTION

Receptacles such as waste cans are known that comprise a container having an open top end into which waste or other articles may be deposited. The container may be made of plastic, metal or other materials and may include a lid that covers the open top end. To facilitate clean up, disposable trash bags or bag liners made of a thin flexible material may be inserted into the container such that waste is deposited into the disposable trash bag or bag liner. The trash bag or bag liner containing the waste and may be removed from the container and disposed of.

SUMMARY OF THE INVENTION

In some embodiments, a receptacle comprises a container having a bottom wall and a side wall extending from the bottom wall. The side wall defines an opening and comprises a front wall portion and a back wall portion. A lid is secured to the container along the back wall portion at a spring hinge. The lid is movable between an open position and a closed position where the lid covers the opening. The front wall portion diverges as it extends away from the bottom wall at a first angle and the back wall portion diverges as it extends away from the bottom wall at a second angle where the first angle is greater than the second angle.

The back wall portion and the bottom wall portion may meet at an edge having a radius of curvature, the radius of curvature of the edge may be approximately equal to or less than ⅛ inch. The bottom wall may define a plane P-P on which the container sits in an upright position and the first angle may be formed between the front wall portion and a line perpendicular to plane P-P and the second angle may be formed between the back wall portion a line perpendicular to plane P-P. In the upright position the plane P-P may be substantially horizontal. The opening may be defined by a rim where the rim may be tilted at an angle relative to plane P-P approximately equal to one-half of the difference between the first angle and the second angle. A front side of the rim may be slightly lower than a back side of the rim. The container may comprise side wall portions connecting the front wall portion to the back wall portion where the side wall portions may be disposed at a draft angle, the average of the first angle and the second angle may be approximately equal to the draft angle. The first angle may be approximately 4 degrees and the second angel may be approximately 2 degrees. A first included angle between the front wall portion and the plane P-P and a second included angle between the back wall portion and the plane P-P may both be greater than 90 degrees. The first included angle may be greater than the second included angle. The spring hinge may be releasably connected to the container. The opening may be defined by a rim and the spring hinge may define an axis of rotation of the lid where the axis of rotation of the lid is disposed outside of the rim. A force generated by the spring hinge may be selected such that the force moves the lid from the closed position to the open position. A latch may hold the lid in the closed position. The lid may be shaped and dimensioned such that the lid contacts the rim for substantially the entire periphery thereof. The rim may comprise an upstanding flange that extends from the rim and that is positioned inside of the lid when the lid is in the closed position. A bag lock may be provided for holding a bag liner in the container. The bag lock may comprise a member disposed adjacent to the side wall and mounted so as to be vertically displaceable relative to the container such that a bag liner may be trapped between the member and the sidewall. The member may comprise a retainer for holding the member in a raised position and a lowered position relative to the container.

In some embodiments, a receptacle comprises a container having a bottom wall and a side wall extending from the bottom wall. The side wall defines an opening and comprises a front wall portion and a back wall portion. A lid is secured to the container along the back wall portion where the lid covers the opening. A spring hinge moves the lid from a closed position to an open position. The front wall portion is angled away from the back wall portion as the front wall portion and the back wall portion extend away from the bottom wall. The front wall portion is disposed at a greater angle relative to vertical than the back wall portion when the container is in the upright position.

DETAILED DESCRIPTION OF PREFERRED EMBODIMENTS OF THE INVENTION

Figure 1:
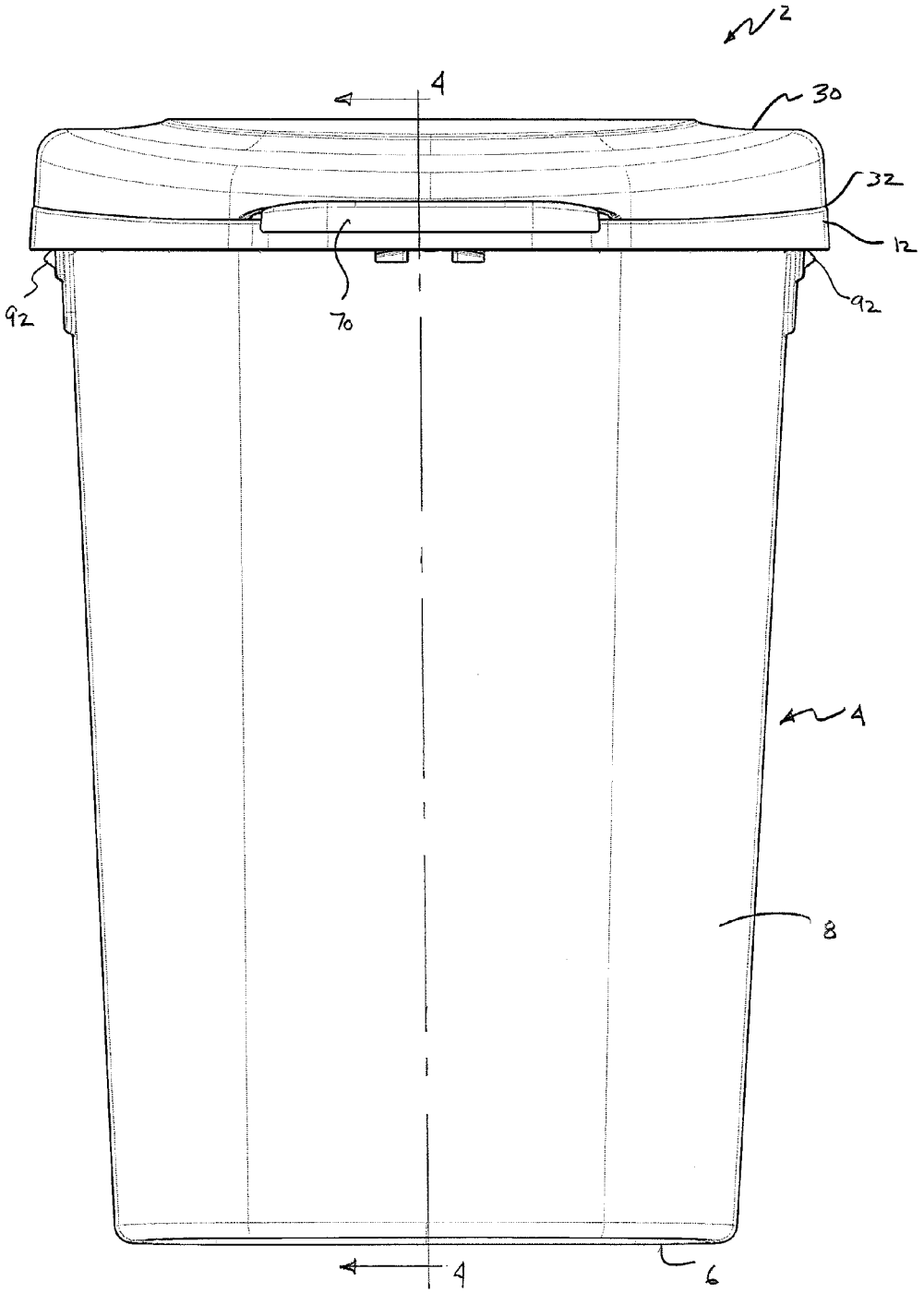
FIG. 1 is a front view of an embodiment of the receptacle of the invention with the lid in the closed position.
Figure 2:
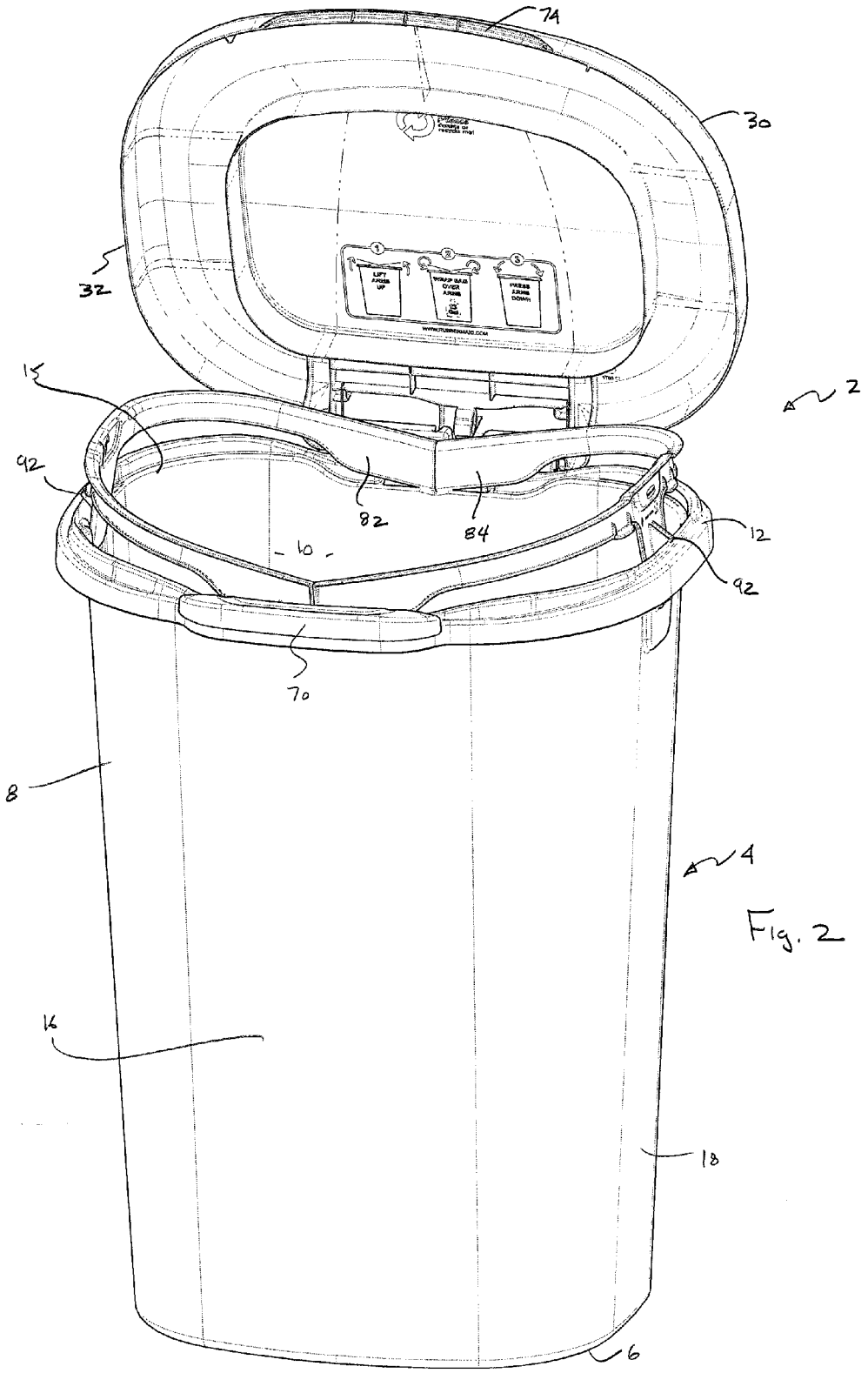
FIG. 2 is a side view of the receptacle of FIG. 1 with the lid in the open position.
Figure 3:
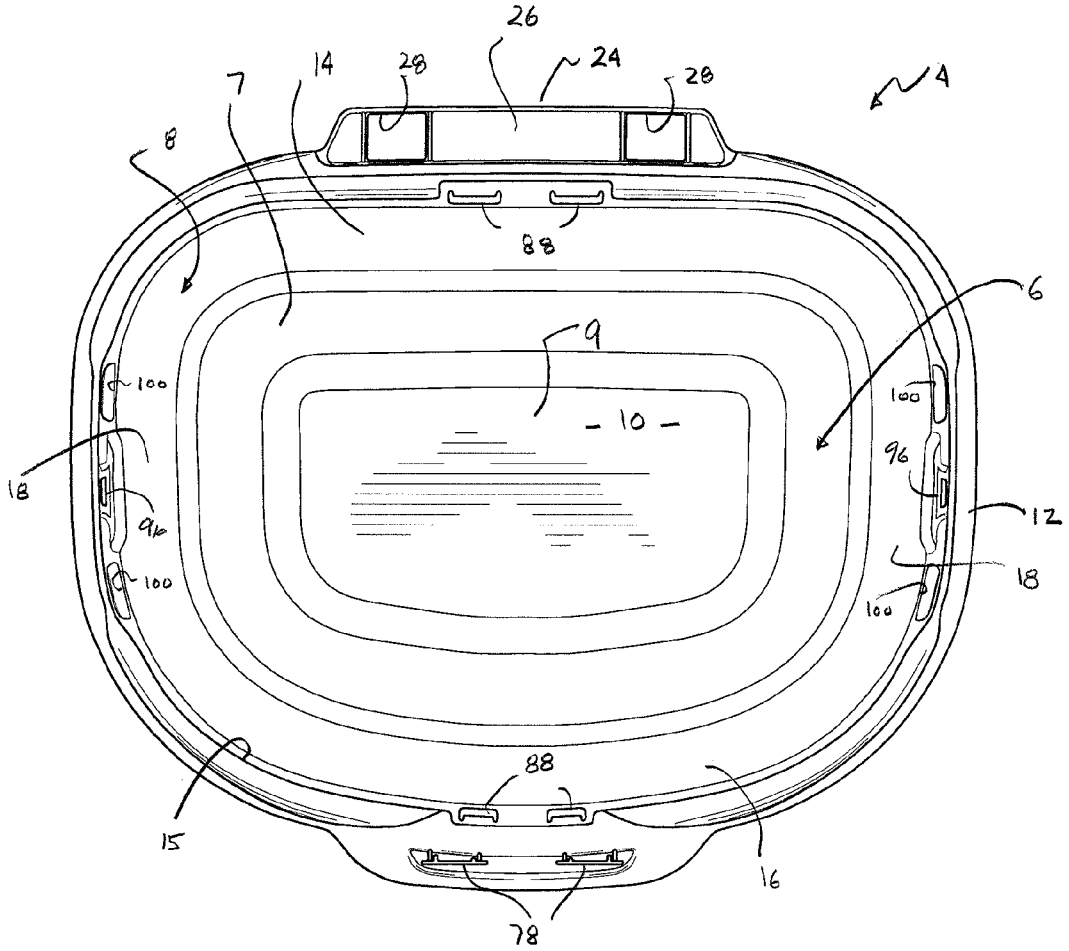
FIG. 3 is a top view of the container of the receptacle of FIG. 1.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element to another element as illustrated in the figures. It will be understood that these terms are intended to set forth the orientation of different components of the device in relationship to one another.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, steps, operations, elements, and/or components, but do not preclude the presence or addition of one or more other features, steps, operations, elements, components, and/or groups thereof.

Embodiments of a receptacle such as a waste can or other receptacle are shown and described herein that include a container having a generally upwardly extending side wall and a bottom wall defining an interior space for receiving trash, recyclables, other waste or other articles. While in one embodiment the receptacle is used as a waste container the receptacle may be used to hold any article. The container may be made of any rigid or semi-rigid material including plastic, metal or the like. In one preferred embodiment, injection molded poly-propylene may be used although other materials may also be used. The container comprises a top rim that defines an opening into the interior space.

A lid is connected to the container at a spring loaded hinge such that the lid is biased to pivot between a closed position and an open position relative to the container to uncover the opening and allow access to the interior space. A latch may be formed opposite the hinge. The latch includes an engagement member that engages the lid to lock the lid in the closed position. A user may operate the latch to disengage the engagement member from the lid. When the engagement member is disengaged, the lid is moved to the open position by the spring loaded hinge.

The lid is secured to the top edge of the container and is dimensioned such that it fully closes the opening in the container without use of an intermediate component such as a shroud. Because the lid fully closes the opening, the lid forms a seal with the rim of the container that minimizes odor that may emanate from the closed container. The elimination of a shroud or other intermediate component also allows the full opening of the container to be used providing easier access to the interior of the container. Moreover, closing the lid directly on the rim of the container provides better aesthetics as the container is completely closed such that the bag liner or other internal components or articles are not visible.

In order to accommodate the full size lid and allow complete closure between the lid and the container, the spring hinge is mounted outside of the perimeter of opening. Because the lid must be large enough to cover the opening, the spring force required to open the lid is greater than with a lid that fits a reduced size opening such as found with a receptacle that uses an intermediate shroud between the container and the lid. The location of the spring and the relatively large spring force required to open the full size lid means that the force generated by the movement of the lid from the closed to the open position may be great enough to tip the container over. To avoid this undesirable occurrence, the container is designed with a forward "lean" where the center of gravity of the upright container is located towards the front of the container. The lower back edge of the container between the bottom wall and the back wall portion of the container is also made with a relatively small radius to prevent the container from pivoting about this edge. As a result, the receptacle is maintained in the upright position even as the lid is pivoted from the closed position to the open position under the relatively large force generated by the spring hinge.

Figure 4:
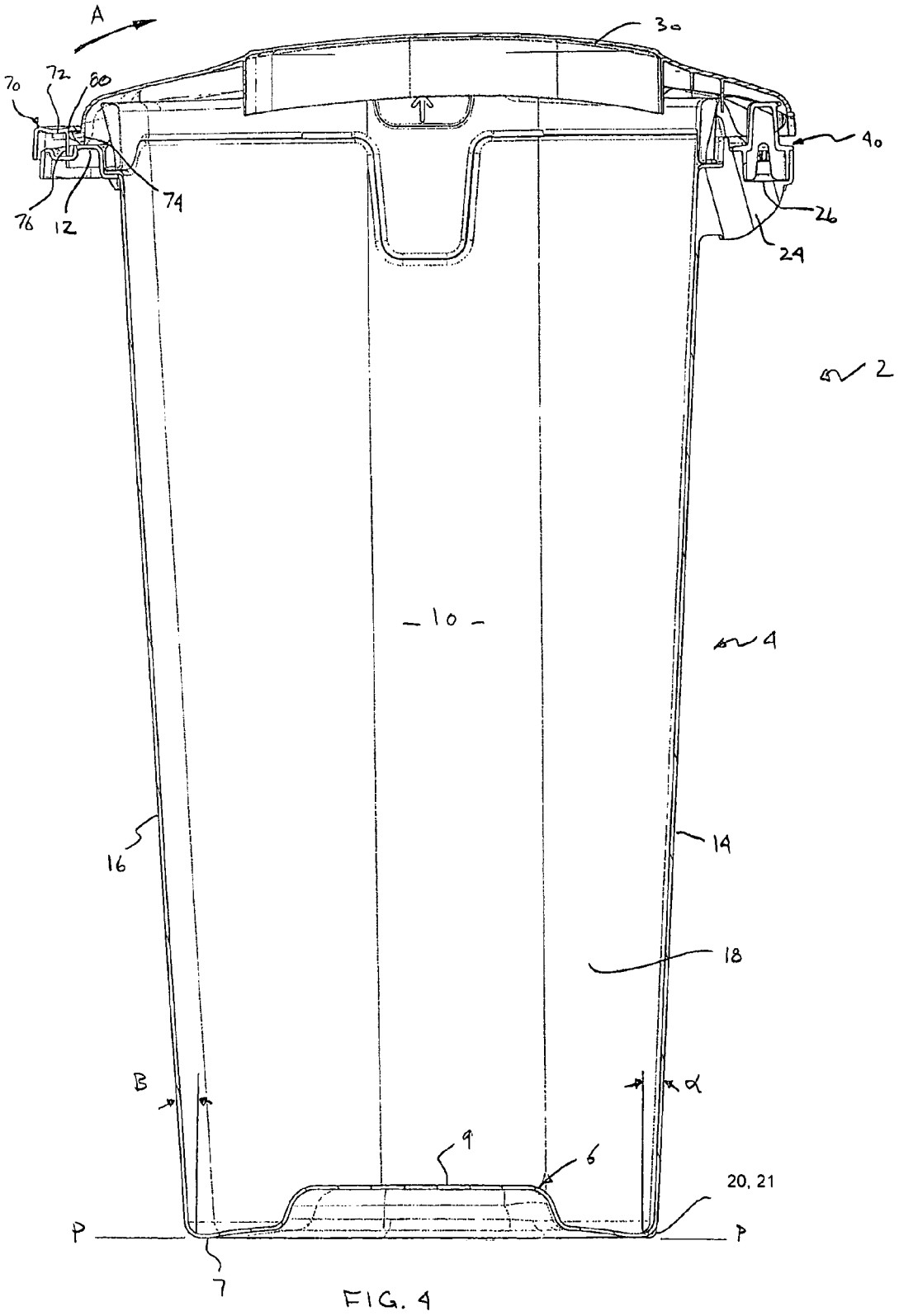
FIG. 4 is a section view of the receptacle taken along line 4-4 of FIG. 1.
Figure 5:
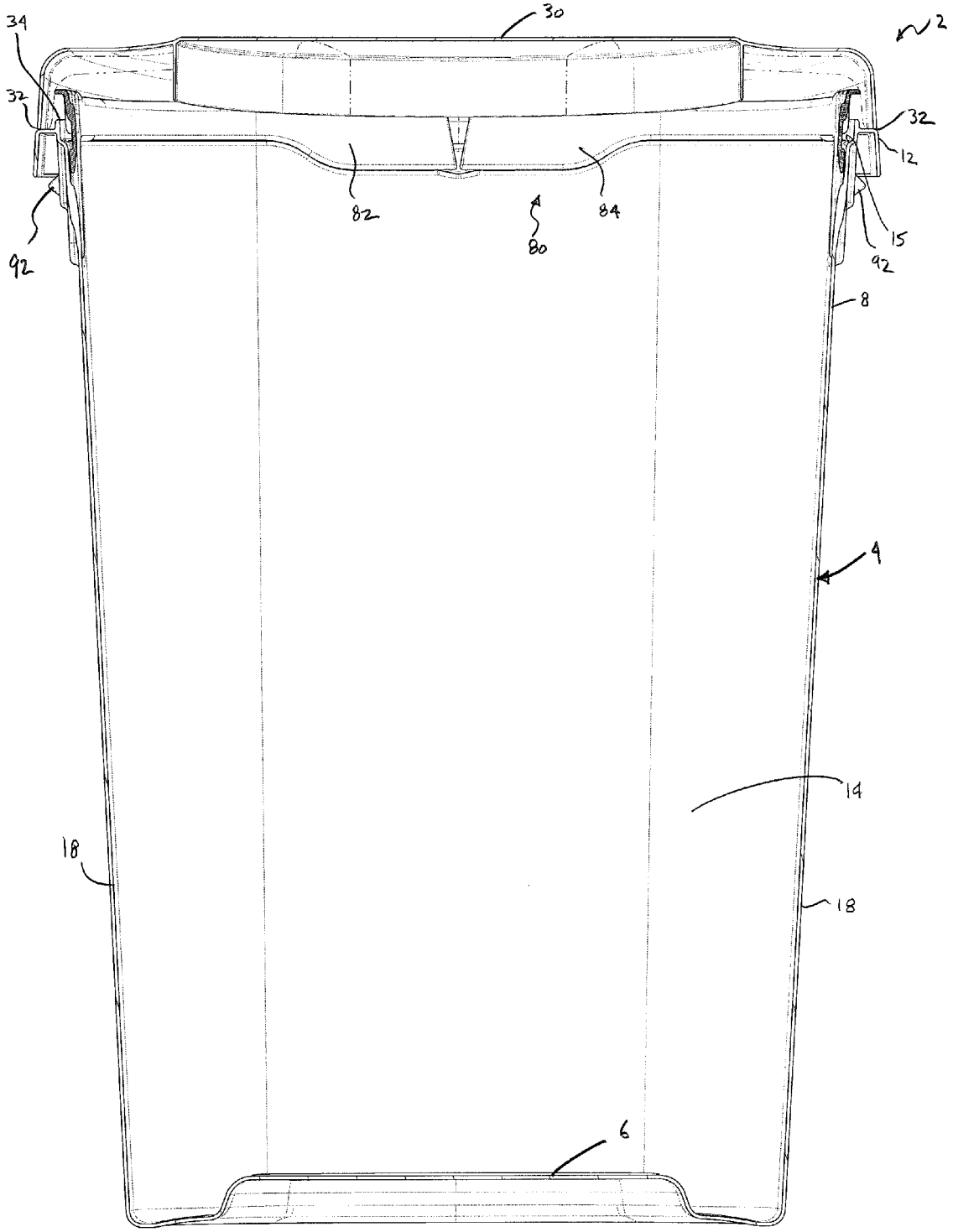
FIG. 5 is a section view of the receptacle of FIG. 1 taken at a 90 degree angle to the section view of FIG. 4.
Figure 6:
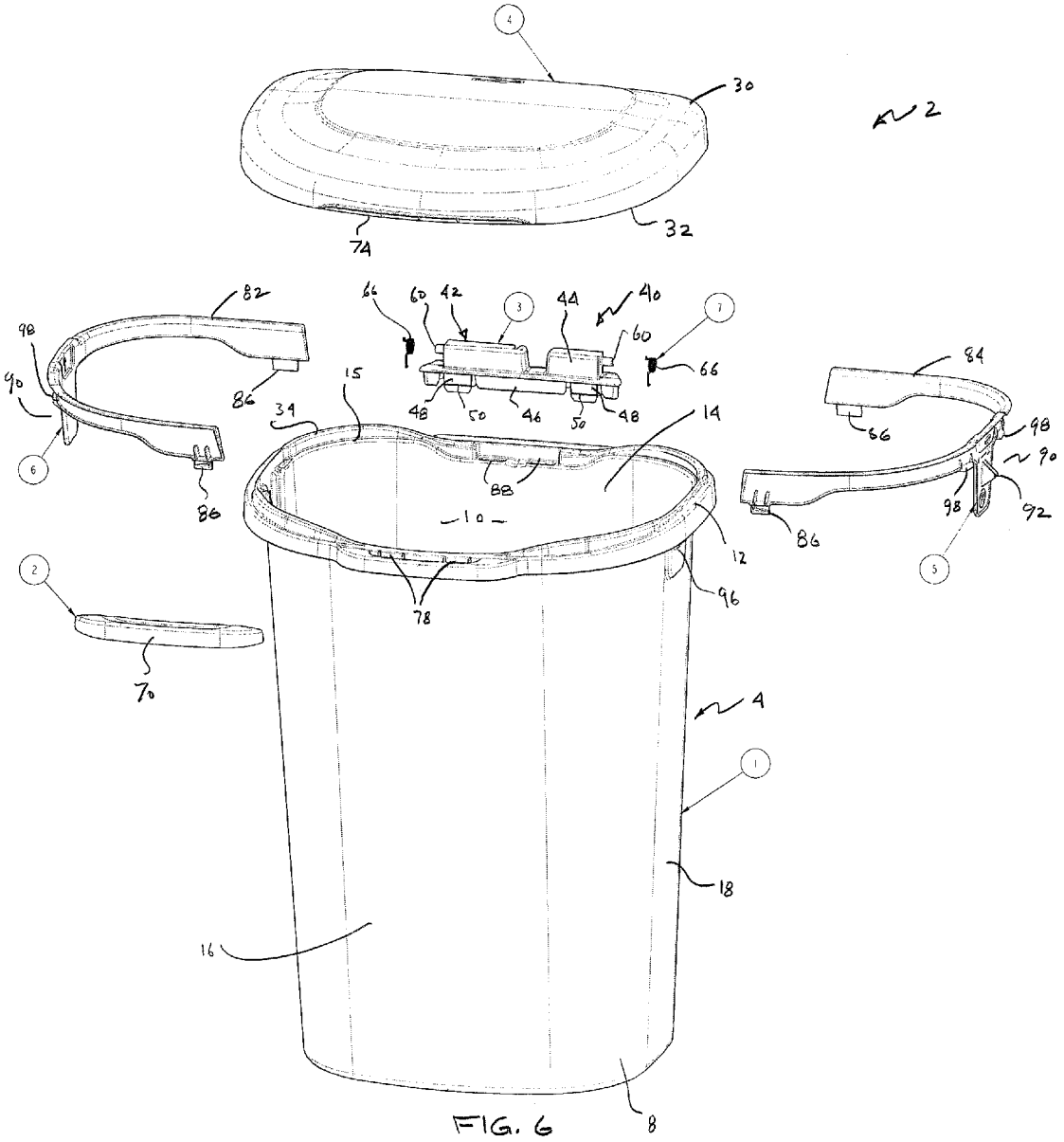
FIG. 6 is an exploded perspective view of the receptacle of FIG. 1.

Referring to the figures an embodiment of the receptacle 2 is shown comprising a container 4. The container 4 has a bottom wall 6 that defines a support surface for supporting the container in an upright position. While the bottom wall 6 defines a support surface for supporting the container 4 on a planar surface, the bottom wall 6 may not be a planar member such that the bottom wall may have contours, indentations or the like as shown in FIG. 4 provided that it may support the container in an upright position. Typically the bottom wall defines a support surface or surfaces that together define a planar surface for supporting the container in an upright position. For example, in the illustrated embodiment the bottom 6 defines a recessed area 9 surrounded by a generally rectilinear area 7 that defines a support plane P-P that may rest on a surface such as a floor or the like to support the container in an upright position. Extending upwardly from the bottom wall 6 is a sidewall 8 that defines an interior space 10. The sidewall 8 terminates in an upper rim 12 that defines an opening 15 that allows access into the interior space 10.

The sidewall 8 may have a variety of shapes. In one embodiment the sidewall 8 has a rounded-off rectangular shape where a back wall portion 14 is connected to a front wall portion 16 by sidewall portions 18 at curved corners. The back wall portion 14 is connected to the bottom wall 6 to define a back edge 20.

The side wall 8 is arranged to maintain the container in an upright position when the lid 30 is moved from the closed position to the open position under the power of the spring hinge 40. It will be understood that when the lid 30 is moved from the closed position to the open position by the spring hinge 40 a force is generated, as represented by arrow A in FIG. 4, tending to tip the top end of the container 4 backwards in the direction of arrow A about the back edge 20. In some embodiments the back edge 20 may be configured to prevent the container from tipping over when the lid 30 is opened. In a container such as described herein, such as a molded plastic container, a sharp corner between two adjacent sides creates high stress areas that may fail if impacted such as by dropping the container on the sharp corner. To prevent these high stress areas, corners may typically be formed as curves with relatively large radii of curvature. While a corner having a relatively large radius of curvature generates lower accumulated stresses and, therefore, minimizes the likelihood of a failure, providing a relatively large curvature on back edge 20 increases the likelihood that the container 4 will tip over when the lid 30 is opened. To minimize the possibility of the container tipping over when the lid is opened, the corner formed at the back edge 20 of the container 4 is formed with a relatively small radius of curvature 21. In one embodiment, the radius of curvature 21 of the back edge 20 may be approximately ⅛ inch. This relatively small radius of curvature 21 prevents the container from "rolling" on the corner and tipping over. Such a radius 21 has been found to minimize tipping of the container without increasing the stresses formed at the corner to a point where the container will fail if subject to an impact. The radius of curvature 21 may be made less than ⅛ inch and may in some embodiments comprise a right angle.

To further minimize the likelihood that the container will tip over, the container is formed with a forward bias or lean such that the center of gravity of the container is displaced closer to the front of the container than the back of the container. In one embodiment, the forward bias is created by the arrangement of the front wall portion 16 and back wall portion 14 relative to the bottom wall 6. Referring to FIG. 4, the bottom wall 6 defines a support plane P-P on which the container 4 sits in the upright position. In typical use the plane P-P rests on a floor or other surface and the plane P-P is horizontal or approximately horizontal during use of the receptacle. The front wall portion 16 and back wall portion 14 are both disposed at a diverging angle relative to the plane P-P defined by the bottom wall 6 such that the front wall portion 16 and back wall portion 14 diverge as they extend away from the bottom wall 6. As used herein, diverging means that the front wall portion 16 and back wall portion 14 extend outwardly as the front and back wall portions extend from the bottom wall 6. Thus, the front wall portion 16 and the back wall portion 14 extend away from one another as the front wall portion and the back wall portion extend away from the base. The included angle between the front wall portion 16 and the plane P-P and the included angle between the back wall portion 14 and the plane P-P are both greater than 90 degrees where the included angle between the front wall portion and the plane P-P is greater than the included angle between the back wall portion and the plane P-P. In order to create the forward bias of the container the front wall portion 16 extends from the bottom wall 6 at a greater angle than the back wall portion 14. As shown in FIG. 4, the front wall portion 16 is disposed at an angle $\beta$ of approximately 4 degrees relative to a line perpendicular to plane P-P where the included angle between plane P-P and front wall portion 16 is approximately 94 degrees, and the back wall portion 14 is disposed at an angle $\alpha$ of approximately 2 degrees relative to a line perpendicular to plane P-P where the included angle between plane P-P and back wall portion 14 is approximately 92 degrees. As a result of this arrangement, the container 4 leans or is biased slightly towards the front of the container such that the center of gravity of the container is slightly toward the front of the container. The different angles of the front wall portion and the rear wall portion also tilt the top rim 12 of the container 4 approximately 1 degree relative to horizontal such that the front side of the top rim 12 is slightly lower than the back side of the top rim 12. In some embodiments the rim is tilted at an angle relative to plane P-P approximately equal to one-half the difference between angle $\alpha$ and angle $\beta$.

In a typical molded article, such as container 4, the sidewall 8 is formed with a draft angle where the side wall 8 is disposed at an outward angle of approximately 3 degrees relative to the bottom wall 6 to create a draft angle that facilitates the removal of the article from the mold. To manufacture the container as described herein the mold cavity is arranged such that the bottom wall 6 is canted at an angle of approximately 1 degree relative to the parting line of the mold. By this arrangement the draft angle between the molded container 4 and the mold cavity is maintained but the container is formed with the forward bias as described above. The angles of the front and back wall portions relative to plane P-P when averaged may equal the desired draft angle. For example, in the disclosed embodiment the desired draft angle is approximately 3 degrees. The angle $\beta$ of the front wall portion is 4 degrees and the angle $\alpha$ of the back wall portion is approximately 2 degrees such that the average of the two angles is approximately the desired 3 degree draft angle. In the container of the invention the side wall portions 18 may extend at the 3 degree draft angle such that the container is symmetrical across its width but is provided with a frontward bias.

Figure 7:
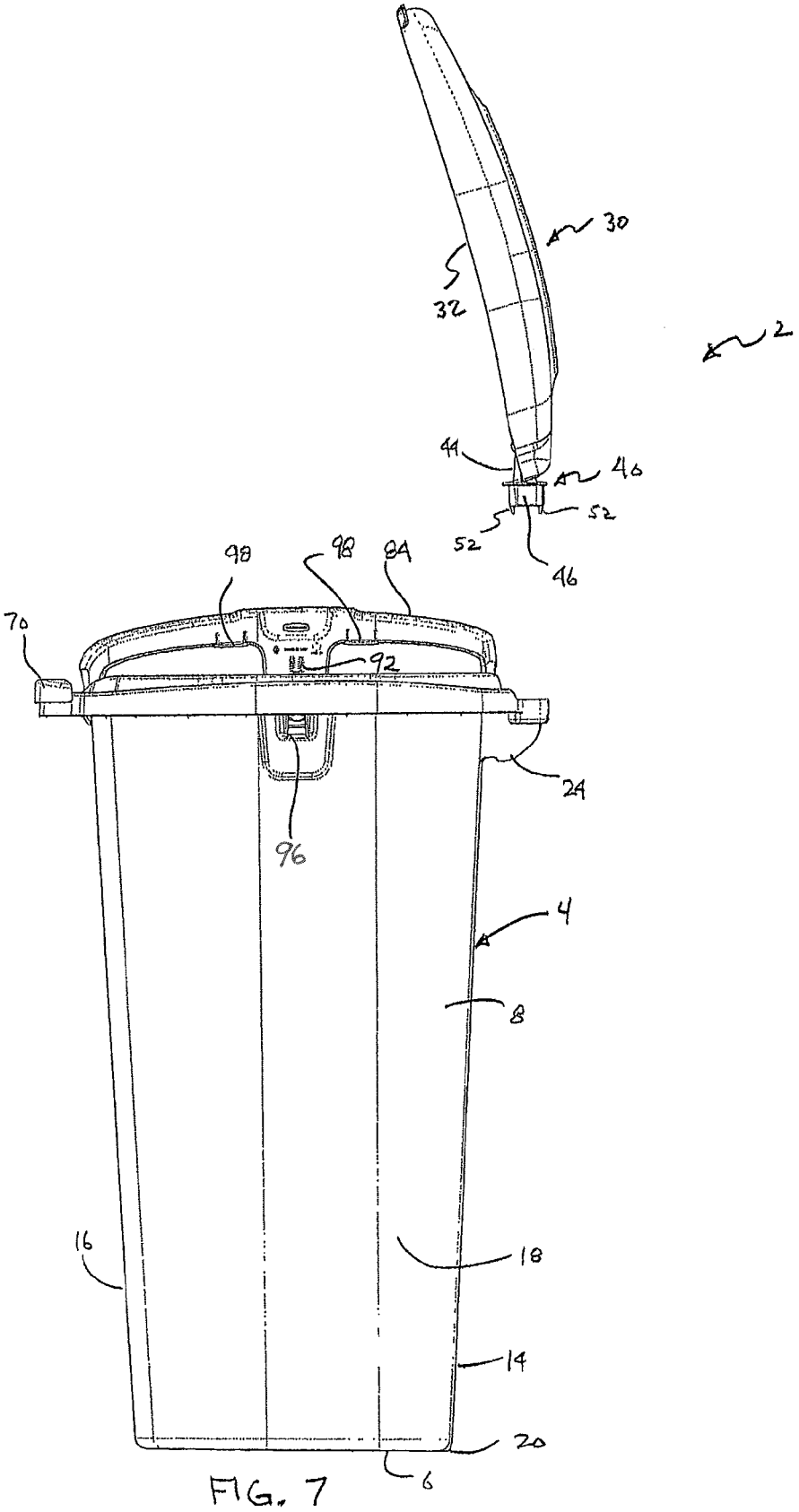
FIG. 7 is a side view of the receptacle of FIG. 1 showing the lid removed from the container.
Figure 8:
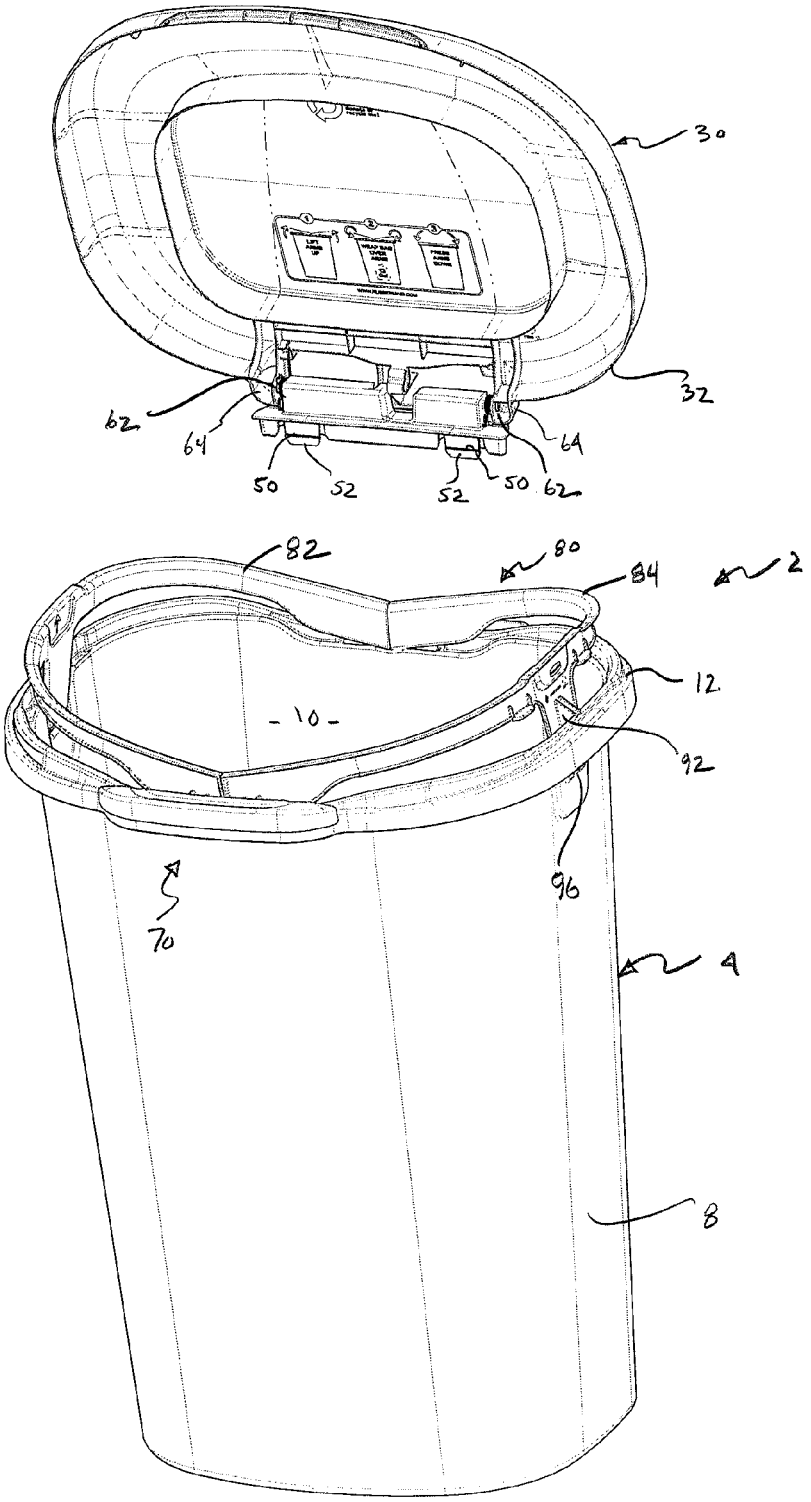
FIG. 8 is a perspective view of the receptacle of FIG. 1 showing the lid removed from the container.

The lid 30 is connected to the container 4 using a spring hinge 40. The spring hinge 40 comprises a body 42 that has an upper portion 44 that is attached to and supports the lid 30 and a lower portion 46 that engages the container 4 to attach the spring hinge 40 to the container 4. In one embodiment the container 4 comprises a support 24 that extends from the outside of the rear wall portion 14 and defines a channel 26. The lower portion 46 of the spring hinge 40 is dimensioned to fit into the channel 26. In some embodiments the lower portion 46 of the spring hinge 40 fits snugly but removably into the channel 26. One of the hinge 40 and the container 4 may be provided with tabs 48 that engage apertures 28 formed in the other one of the hinge 40 and the container 4 to lock the spring hinge to the container. In the illustrated embodiment the tabs 48 are formed on the lower portion of the hinge 40 and the apertures 28 are formed in channel 26. The tabs 48 are arranged in opposed pairs such that the tabs may be moved toward one another to fit into apertures 28 and released to lock against the edges of the apertures 28. The tabs 48 may be flexible such that when the tabs 48 are inserted into the apertures 28 the tabs 48 are deformed. When the tabs 48 are fully inserted into the apertures 28, the tabs 48 return toward the undeformed position to lock the tabs 48 in the apertures 28. The tabs 48 may be formed with locking members 50, such as lateral surfaces, that engage the edges of the apertures 28 in the locked position. The tabs 48 may be moved to the deformed position to unlock the locking members 50 from the apertures 28 such that the lid 30 may be removed from the container such as for cleaning. The lid 30 may be attached to the container 4 by forcing the lower portion 46 of the spring hinge 40 into the channel 26 to engage the tabs 48 with the apertures 28. The tabs 48 may be provided with angled cam surfaces 52 (FIG. 7) that engage the edge of the apertures 28 to facilitate the deforming of the tabs 48 as the hinge 40 is inserted into the channel 26.

The upper portion 44 of the body 42 connects the spring hinge 40 to the lid 30 and comprises a pair of opposed posts 60 that define the pivot axis of the lid 30. The posts 60 are received in apertures 62 formed in support structures 64 on the lid such that the posts may rotate in the apertures. The hinge 40 is arranged such that the axis of rotation of the lid 30 is disposed to the outside of the opening 15 and rim 12. Torsion springs 66 are located on posts 60 between the body 42 and the support structures 64 and are disposed to bias the lid 30 to the open position. In one embodiment the torsion springs 66 have one end held against the body 42 and the opposite end against the lid 30. When the lid 30 is closed the springs 66 are compressed such that when the lid is released, the springs 66 move the lid from the closed position to the open position. The spring force generated by the hinge 40 is selected such that the hinge moves the lid from the closed position to the open position.

To hold the lid in the closed position against the force generated by the spring hinge 40 a latch 70 is provided opposite to hinge 40. The latch 70 comprises a movable locking member 72 that releasably engages a lip or other mating engagement structure 74 formed on the lid 30. The locking member 72 may comprise a deformable member 76 that is retained in an aperture or a plurality of apertures 78 formed along the rim 12 of the container 4. The locking member 72 moves between a locked position where the locking member engages the lip 74 and an unlocked position where the locking member is removed from engagement with the lip 74. When the latch is moved by a user to the unlocked position the lid 30 is rotated to the open position by springs 66. The resiliency of the deformable member 76 may be used to bias the locking member 72 to the locked position. In other embodiments a separate biasing mechanism such as a spring may be used to bias the locking member to the locked position. The lip 74 may be formed with an angled face 80 that is shaped to move the locking member 72 from the locked position to the unlocked position when the lid is moved to the closed position.

The lid 30 is shaped and dimensioned such that the bottom edge 32 of lid 30 sits directly on and abuts the upper surface of the rim 12 for substantially the entire periphery thereof. The rim 12 may comprise an upstanding flange 34 that extends from the upper surface of the rim 14 and that is positioned inside of the edge 32 of the lid 30 to create an overlapping arrangement between the lid and the container. Because the bottom edge 32 of the lid 30 engages the rim 12 of the container 4 for substantially the entire periphery thereof an odor barrier is created to prevent the escape of odors from the container. Tests were conducted comparing the odor retention capability of the present receptacle as compared to a receptacle having a shroud disposed between the lid and container where gaps may exist between the lid and the container. In one test, receptacles of each type were positioned in a chamber and ammonia was placed in each receptacle with the lid closed. Measurements were taken in the chamber for each type of receptacle for the presence of airborne ammonia in the chamber. The results of these tests showed that the receptacle the invention reduced the escape of particles by approximately 63%.

A bag lock 80 may be provided for holding a bag liner or trash bag in the container. In one embodiment, the bag lock 80 comprises a first member 82 that extends for approximately one half of the opening 15 of container 4 and a second member 84 that extends for approximately the other half of the opening 15 of the container. While in the illustrated embodiment the members 82 and 84 each extend for approximately one-half of the opening 15 each of the members may extend for more or less than one half of the container. The members 82 and 84 fit inside of opening 15 and closely match the shape and size of opening 15 such that the members are disposed adjacent to side wall 8. The members 82 and 84 are mounted so as to be vertically displaceable relative to the container 4. A bag liner may be inserted into the container 4 and the top edge of the bag liner may be wrapped around the members 82 and 84. The members 82 and 84 may be lowered onto the container to trap the top edge of the bag liner between the members 82 and 84 and the side wall 8 of the container 4. In one embodiment the ends of the members 82 and 84 comprise tabs 86 that extend into slots 88 formed in the container 4 such that the members 82 and 84 may be raised and rotated relative to the container 4 to create a space between the members 82 and 84 and the container 4. A retainer 90 may be provided to hold the members 82 and 84 in the raised and lowered positions. In one embodiment the retainers 90 comprise protrusions 92 formed on the members 82 and 84 that engage container 4. In the raised position the protrusions 92 engage the rim 12 of the container to hold the members in the elevated position. In the lowered position the protrusions 92 are inserted into apertures 96 in the side wall portions 18 of the container 4 to hold the members 82 and 84 in the lowered position. Additional tabs 98 may be provided that engage apertures 100 when the members 82 and 84 are in the lowered position to further fix the members 82 and 84 in the lowered position.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A receptacle comprising:

a container having a bottom wall and a side wall extending from the bottom wall, the side wall defining an opening and comprising a front wall portion and a back wall portion, the sidewall terminating at a rim, the container having one or more apertures in the sidewall;

a lid secured to the container along the back wall portion at a spring hinge, the lid movable between an open position and a closed position where the lid directly contacts the rim of the container such that the lid completely closes the opening;

the front wall portion diverging as the front wall portion extends away from the bottom wall at a first angle and the back wall portion diverging as the back wall portion extends away from the bottom wall at a second angle where the first angle is greater than the second angle; and a bag lock for holding a bag liner in the container, the bag lock being vertically displaceable, relative to the container, between a raised position and a lowered position, the bag lock comprising one or more protrusions insertable into the one or more apertures in the sidewall to hold the bag lock in the lowered position, and the one or more protrusions configured to engage the rim of the container to hold the bag lock in the raised position.

2. The receptacle of claim 1 wherein the back wall portion and the bottom wall portion meet at an edge having a radius of curvature, the radius of curvature of the edge being approximately equal to or less than ⅛ inch.

3. The receptacle of claim 1 wherein the bottom wall defines a plane P-P on which the container sits in an upright position, the first angle between the front wall portion and a line perpendicular to plane P-P and the second angle between the back wall portion and a line perpendicular to plane P-P.

4. The receptacle of claim 3 wherein in the upright position the plane P-P is substantially horizontal.

5. The receptacle of claim 3 wherein the opening is defined by the rim, the rim being tilted at an angle relative to plane P-P approximately equal to one-half a difference between the first angle and the second angle.

6. The receptacle of claim 5 wherein a front side of the rim is slightly lower than a back side of the rim.

7. The receptacle of claim 3 wherein the container comprises side wall portions connecting the front wall portion to the back wall portion, the side wall portions being disposed at a draft angle, the average of the first angle and the second angle being approximately equal to the draft angle.

8. The receptacle of claim 3 wherein the first angle is approximately 4 degrees and the second angle is approximately 2 degrees.

9. The receptacle of claim 3 wherein a first included angle between the front wall portion and the plane P-P and a second included angle between the back wall portion and the plane P-P are both greater than 90 degrees.

10. The receptacle of claim 9 where the first included angle is greater than the second included angle.

11. The receptacle of claim 1 wherein the spring hinge is releasably connected to the container.

12. The receptacle of claim 1 wherein the opening is defined by the rim and the spring hinge defines an axis of rotation of the lid, the axis of rotation of the lid being disposed outside of the rim.

13. The receptacle of claim 12 wherein a force generated by the spring hinge is selected such that the force moves the lid from the closed position to the open position.

14. The receptacle of claim 13 wherein a latch holds the lid in the closed position.

15. The receptacle of claim 1 wherein the rim comprises an upstanding flange that extends from the rim and that is positioned inside of the lid when the lid is in the closed position.

16. The receptacle of claim 1 wherein the bag lock comprises first and second members disposed adjacent to the side wall and mounted so as to be vertically displaceable relative to the container such that a bag liner may be trapped between the first and second members and the sidewall.

17. A receptacle comprising:

a container having a bottom wall for supporting the container in an upright position, and a side wall extending from the bottom wall, the side wall defining an opening and comprising a front wall portion and a back wall portion, the sidewall terminating in a rim, the container including a support extending outwardly from the sidewall and one or more apertures in the sidewall;

a lid secured to the container along the back wall portion, the lid directly contacting the rim of the container in a closed position such that the lid completely closes the opening;

a spring hinge for moving the lid from the closed position to an open position, the spring hinge comprising a body having one or more downwardly extending tabs removably insertable into a channel defined in the support of the container;

the front wall portion and the back wall portion diverging away from one another as the front wall portion and the back wall portion extend away from the bottom wall; and a bag lock for holding a bag liner in the container, the bag lock being vertically displaceable, relative to the container, between a raised position and a lowered position, the bag lock comprising one or more protrusions insertable into the one or more apertures in the sidewall to hold the bag lock in the lowered position, and the one or more protrusions configured to engage the rim of the container to hold the bag lock in the raised position.

18. The receptacle of claim 17 wherein the bottom wall defines a plane P-P on which the container sits in an upright position, where a first included angle between the front wall portion and the plane P-P and a second included angle between the back wall portion and the plane P-P are both greater than 90 degrees.

19. A receptacle comprising:

a container having a bottom wall and a side wall extending from the bottom wall, the side wall defining an opening and comprising a front wall portion and a back wall portion, the sidewall terminating in a rim;

a lid secured to the container along the back wall portion at a spring hinge, the lid movable between an open position and a closed position where the lid covers the opening;

the container comprising one or more apertures in the sidewall of the container and one or more slots formed in the container proximate to the rim;

the front wall portion diverging as the front wall portion extends away from the bottom wall at a first angle and the back wall portion diverging as the back wall portion extends away from the bottom wall at a second angle where the first angle is greater than the second angle; and a bag lock for holding a bag liner in the container, the bag lock comprising one or more downwardly extending tabs movably disposed within the one or more slots such that the bag lock is vertically displaceable, relative to the container, between a raised position and a lowered position, the bag lock comprising a retainer comprising one or more protrusions insertable into the one or more apertures in the sidewall to hold the bag lock in the lowered position, the one or more apertures configured to engage the rim of the container to hold the bag lock in the raised position.

20. The receptacle of claim 19, wherein the one or more apertures comprise a first aperture in a first portion of the sidewall and a second aperture in a second portion of the sidewall, wherein the one or protrusions comprise first and second protrusions, wherein the bag lock comprises first and second members disposed adjacent to the sidewall and vertically displaceable relative to the container, wherein the first member and second members comprise the first and second protrusions, the first and second protrusions being insertable into the first and second apertures, respectively, to hold the bag lock in the lowered position, the first and second protrusions configured to engage the rim of the container to hold the bag lock in the raised position.

* * * * *